US006502279B2

(12) United States Patent
Marazzi et al.

(10) Patent No.: US 6,502,279 B2
(45) Date of Patent: Jan. 7, 2003

(54) TURBO-BRUSH FOR CLEANING A SURFACE

(75) Inventors: Raffaele Marazzi, Casciago (IT); Ermes Roschi, Varese (IT)

(73) Assignee: New Ermes Europe S.p.A., Albizzate (IT)

( * ) Notice: Subject to any disclaimer, the term of this patent is extended or adjusted under 35 U.S.C. 154(b) by 0 days.

(21) Appl. No.: 09/769,725

(22) Filed: Jan. 26, 2001

(65) Prior Publication Data

US 2001/0011403 A1 Aug. 9, 2001

(30) Foreign Application Priority Data

Jan. 27, 2000 (EP) ..... 00830049

(51) Int. Cl.[7] ..... A47L 5/30
(52) U.S. Cl. ..... 15/387; 15/326
(58) Field of Search ..... 15/326, 387

(56) References Cited

U.S. PATENT DOCUMENTS 5,008,973 A * 4/1991 Wörwag ..... 15/331
5,249,333 A * 10/1993 Wörwag ..... 15/387
5,293,665 A * 3/1994 Wörwag ..... 15/328
5,345,650 A * 9/1994 Downham et al. ..... 15/331
5,416,948 A * 5/1995 Wörwag ..... 15/331
5,471,707 A * 12/1995 Kang ..... 15/326
5,517,716 A 5/1996 Park ..... 15/326
5,919,030 A * 7/1999 Iwatake et al. ..... 15/326
5,950,275 A * 9/1999 Wörwag ..... 15/387
6,035,485 A * 3/2000 Holsten ..... 15/326
6,151,752 A * 11/2000 Melzner et al. ..... 15/387

FOREIGN PATENT DOCUMENTS

DE 41 08 900 11/1992

OTHER PUBLICATIONS

Patent Abstracts of Japan vol. 014, No. 427 (C–0758), Sep. 1990 & JP 02 164324 (Tokyo Electric Co Ltd), Jun. 1990.
Patent Abstracts of Japan vol. 1995, No. 02, Mar. 1995 & JP 06 319669 (Hitachi Ltd), Nov. 1994.

* cited by examiner

*Primary Examiner*—Theresa T. Snider
(74) *Attorney, Agent, or Firm*—Nixon & Vanderhye P.C.

(57) ABSTRACT

A turbo-brush for cleaning a surface includes a casing provided with a suction opening, a rotating brush, a turbine which has a rotor provided with vanes and is operationally connected to the brush, a suction nozzle and a suction pipe connected to a suction device; the casing has a housing inside which the turbine is rotatably supported for rotating about an axis of rotation; the suction nozzle is located between said brush and said turbine for sucking an air flow from the suction opening, direct it onto the brush and then towards the turbine; the housing of the turbine has at least one lip projecting to a distance from an outer end of the vanes of the turbine which ranges from 0.001% to about 0.1% of the diameter of said rotor of said turbine.

19 Claims, 3 Drawing Sheets

TURBO-BRUSH FOR CLEANING A SURFACE

FIELD OF THE INVENTION

This application is based on European Patent Application No. 00830049.3 filed on Jan. 27, 2000, the content of which is incorporated hereinto by reference.

The present invention relates to a turbo-brush for cleaning a surface, such as, for example, a fabric surface, tapestry, furnishing, moquette, carpet and the like.

BACKGROUND AND SUMMARY OF THE INVENTION

Generally, a turbo-brush comprises a rotating brush provided with bristles and actuated by a turbine with radial vanes. The rotating brush and the turbine are rotatably supported in two respective housings of a casing. The casing has a suction opening, inside which the rotating brush is placed, and a suction nozzle, located between the rotating brush and the turbine. A suction pipe, which is connected to a suction device, communicates with the suction nozzle and the turbine housing.

When the suction device is in operation, a flow of air, dust and other rubbish passes through the suction opening, the nozzle and the suction pipe and strikes the vanes of the turbine, causing the latter to rotate. The turbine transmits the rotary movement to the brush via a toothed belt, and the brush, rotating, with its bristles passes over the surface to be cleaned (fabric surface, which may be padded, tapestry, furnishing, moquette, carpet and the like), removing the dust and rubbish which are sucked up by the air flow generated by the suction device.

In turbo-brushes of this type, the turbine must supply the power necessary for overcoming the friction which is produced between the bristles of the brush and the surface to be cleaned, in addition to the friction which occurs between the shafts of the brush and the turbine and their support bearings.

The turbine supplies this power when the air flow passing through the suction nozzle strikes it with sufficient energy.

In order to exploit most efficiently the energy of the air flow, the vanes of the turbine must be struck by the whole flow discharged from the suction nozzle. For this purpose the turbine is usually positioned so that its bottom vanes are located opposite the nozzle outlet and so that their outer ends are very close to the bottom of the casing.

A drawback of this positioning of the turbine is the high aerodynamic noise level due to the intermittent interaction between the air flow leaving the nozzle and the turbine vanes.

In order to reduce this noise level, attempts have been made to increase the distance between the outer ends of the vanes and the bottom of the casing. In doing so, however, the turbine power is reduced.

The inventor has perceived that this reduction in power is due to the fact that a part of the air flow flows back inside the housing of the turbine without transmitting its energy to the said turbine and becomes a source of dissipation.

The object of the present invention is to reduce the noise level of a turbo-brush without adversely affecting the power supplied by the turbine.

The abovementioned object is achieved, in accordance with the invention, by means of a turbo-brush for cleaning a surface, comprising a casing provided with a suction opening, a rotating brush provided with bristles, a turbine which has a rotor provided with vanes and is operationally connected to said brush, a suction nozzle and a suction pipe connected to a suction device, said casing having a housing inside which said turbine is rotatably supported for rotating about an axis of rotation, said suction opening being located between said brush and said turbine for sucking a flow of air from said suction opening, direct it onto said brush and then towards said turbine, characterized in that said housing of said turbine has at least one lip projecting to a distance from an outer end of the vanes of said turbine which ranges from about 0.001% to about 0.1% of the diameter of said rotor of said turbine.

In particular, said distance ranges from about 0.002% to about 0.02% of the diameter of said rotor.

Preferably, said distance is about 0.002% of the diameter of said rotor.

Advantageously, said at least one lip is located at an angle which ranges from about −60° to about 180° with respect to an axis parallel to a surface to be cleaned, having its origin on the axis of rotation of said turbine and directed towards said brush, the angles measured in the opposite direction with respect to the direction of rotation of said turbine being positive.

Preferably, said angle ranges from about −40° to about 130°.

Advantageously, said angle is about 1°.

According to a variation, said angle is about 120°.

Advantageously, said housing of said turbine has two lips projecting to the abovementioned distance from the outer end of said vanes, said two lips being located at respective angles which range from about −60° to about 180° with respect to an axis parallel to a surface to be cleaned, having its origin on the axis of rotation of said turbine and directed towards said brush, the angles measured in the opposite direction with respect to the direction of rotation of said turbine being positive.

Preferably, said two lips are located at respective angles which range from about −40° to about 130° with respect to said axis parallel to the surface to be cleaned.

In particular, said two lips are located, one at an angle of about 20° and the other at an angle of about 45° with respect to said axis parallel to the surface to be cleaned.

Advantageously, said turbo-brush comprises an acoustic damper associated with said housing of said turbine, said acoustic damper having a predefined volume and being connected to said housing of said turbine by means of a baffle provided with a predefined number of holes having predefined dimensions, said volume, said number of holes and their dimensions having values such as to dampen at least one predefined acoustic frequency.

Preferably, the volume of said acoustic damper ranges from about 1% to about 20% of the overall volume of said turbine, and said holes have a diameter which ranges from about 0.5 mm to about 5 mm and a length which ranges from about 0.5 mm to about 4 mm and consist of a number which ranges from 1 to 100.

In particular, the volume of said acoustic damper is about 7% of the overall volume of said turbine, and said holes have a diameter of about 2.5 mm and a length of about 1.5 mm and consist of a number equal to 35.

Advantageously, said baffle has a porosity, understood as being the ratio of voids to solid areas, which ranges from about 1% to about 50%.

Preferably, said porosity ranges from about 5% to about 20%.

Advantageously, said damper has a height, measured with respect to the line of intersection between said baffle and a plane of longitudinal cross section, which assumes values inversely proportional to the frequencies to be dampened.

Preferably, said damper has a height which ranges from about 1 to about 30 mm.

In particular, said height ranges from about 6 to about 12 mm.

Advantageously, said suction nozzle has an elongation ratio b/h, between width b and height h, which ranges from about 3 to about 7.

In the turbo-brush according to the invention, the use of one or two lips which project from the housing of the turbine and which are very close to the outer ends of the turbine vanes constitutes a very effective obstacle to the formation of an air flow recirculating between the top part of the turbine and its housing. Therefore, it is possible to exploit all the energy which is contained in the air jet which strikes the turbine and obtain from it the maximum power.

As a result of this, a space suitable for absorbing the noise may be left around the turbine. In fact, in the turbo-brush according to the invention it is possible to arrange the outer ends of the vanes at a distance from the turbine housing, except for the lip zones, without adversely affecting the performance of the turbine in view of the absence of a recirculating flow.

Moreover, the acoustic damper connected to the turbine housing may be provided with dimensions suitable for damping the most troublesome acoustic frequencies. Therefore, it may be a multiple, i.e. it may silence more than one frequency, thus making it possible to achieve a significant reduction in the noise produced by the turbine.

BRIEF DESCRIPTION OF THE DRAWINGS

Further characteristic features and advantages of the invention will now be illustrated with reference to embodiments shown by way of a non-limiting example in the accompanying figures in which.

DETAILED DESCRIPTION OF THE DRAWINGS

Figure 1:
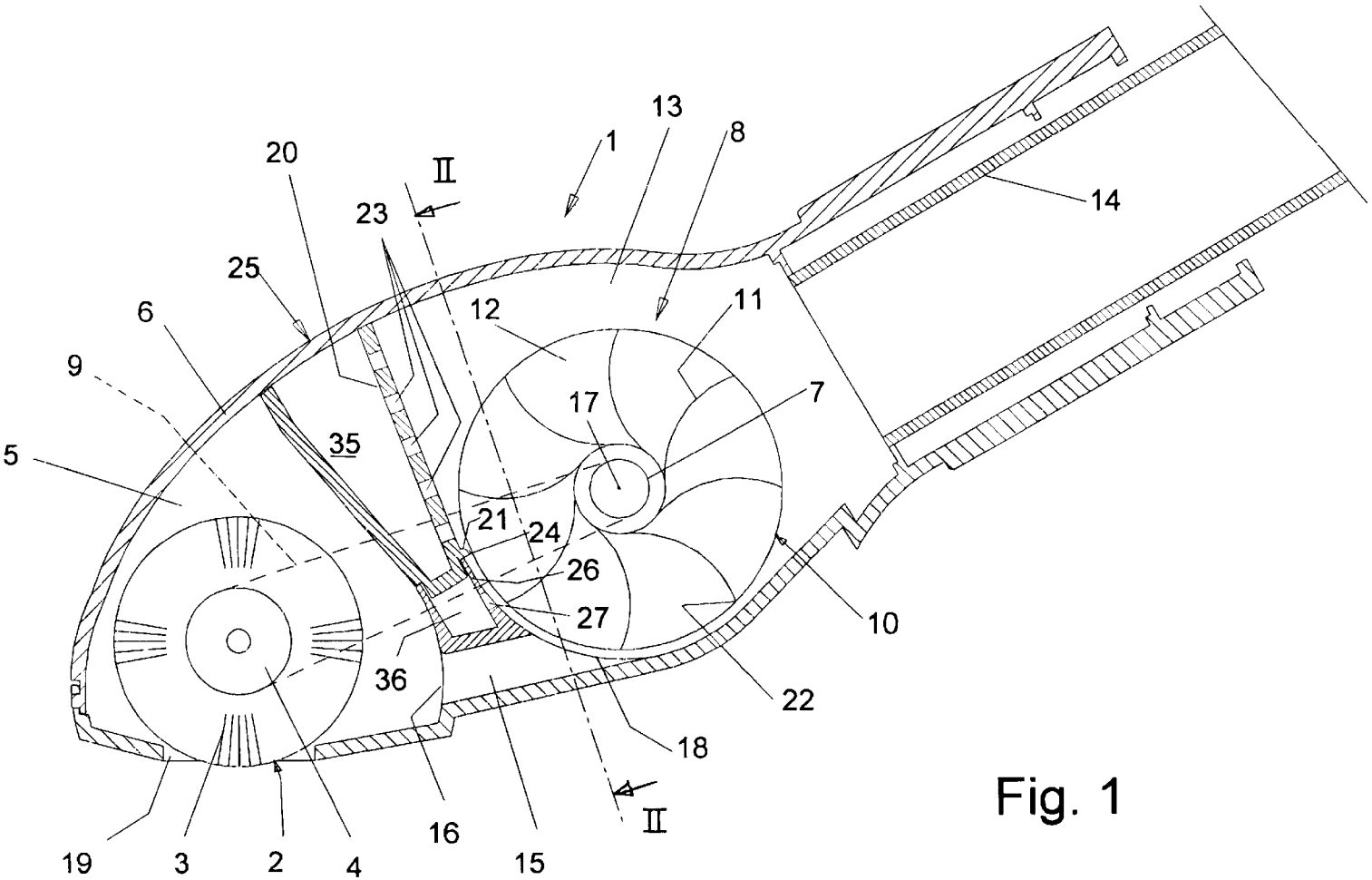
FIG. 1 is longitudinally sectioned partial view of a turbo-brush provided in accordance with the invention.
Figure 2:
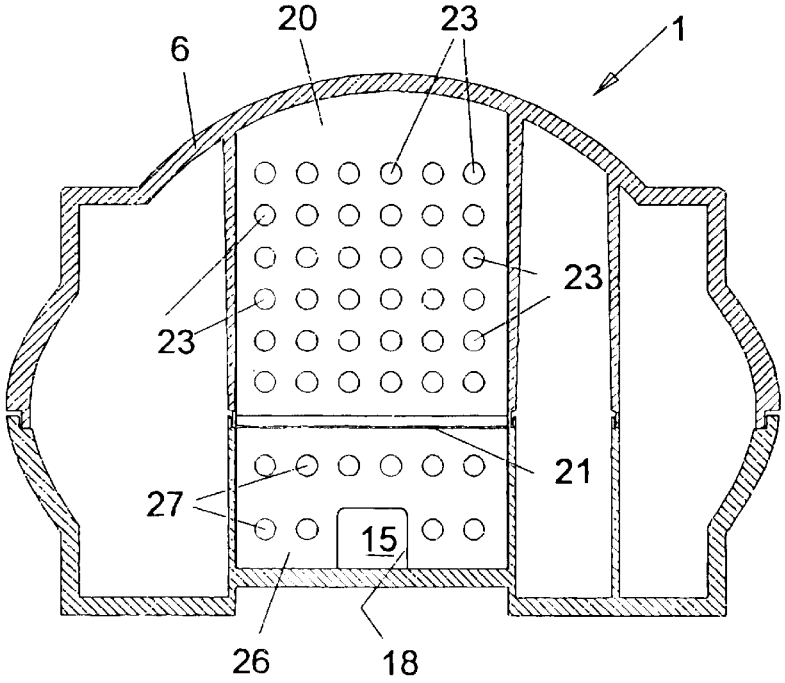
FIG. 2 is a cross-sectional view along the plane indicated by II—II in FIG. 1.

FIGS. 1 and 2 show a turbo-brush 1 for cleaning a surface, such as, for example, a fabric surface, tapestry, furnishing, moquette, carpet and the like. The turbo-brush 1 comprises a rotating brush 2 provided with bristles 3.

The brush 2 has a shaft 4 rotatably supported in a housing 5 of a casing 6. The brush 2 is made to rotate, in an anti-clockwise direction in the plane of FIG. 1, by a turbine 8 via a toothed belt 9 and toothed pulleys, not shown. The turbine 8 has a shaft 7 and a rotor 10 provided with radial vanes 11 with which two end disks 12 are integral. The shaft 7 of the turbine 8 is rotatably supported in a housing 13 of the casing 6. A suction pipe 14, which is fixed to the casing 6, communicates with the housing 13 of the turbine 8 and is connected to a suction device not shown in that it is known to the person skilled in the art. The brush 2 is placed inside a suction opening 19 which is located in the bottom zone of the housing 5. A suction nozzle 15 is located between the housing 5 of the brush 2 and the housing 13 of the turbine 8, in the bottom zone of the casing 6. The nozzle 15 has an inlet port 16 which opens out in the vicinity of a bottom portion of the brush 2 and an outlet port 18 which emerges in the vicinity of the bottom vanes 11 of the turbine 8.

The housing 13 of the turbine 8 is delimited by a perforated baffle 20 provided with a plurality of holes 23 and by a perforated baffle 26 provided with holes 27, the function of which will be illustrated further below. The perforated baffle 20 has, integral with it, a lip 21 which projects towards the turbine 8. The lip 21 has a height which ranges from 3 mm to about 8 mm and which, particularly, is about 5 mm. The tip 24 of the lip 21 is located at a distance from the outer end 22 of the vanes 11 which is as small as possible in view of the structural features of the turbo-brush. This distance ranges from about 0.001% to about 0.1% of the diameter of the rotor 10 of the turbine 8. In particular it ranges from about 0.002% to about 0.02% of the diameter of the rotor 10, and preferably is about 0.002%. For example, the distance ranges from about 0.05 mm to about 5 mm; in particular, it ranges from about 0.1 mm to about 1 mm and, preferably, is about 0.1 mm, while the diameter of the turbine is about 55 mm. The lip 21 is located at an angle which ranges from about −60° to about 180° with respect to an axis parallel to a surface to be cleaned, having its origin on the axis 17 of the rotational shaft 7 of the turbine 8 and directed towards the brush 2, the angles measured in the opposite direction with respect to the direction of rotation of the turbine being positive. For example, said angle ranges from about −40° to about 130°. Particularly, the lip 21 is located at about 1° with respect to the axis parallel to the surface to be cleaned.

The function of the lip 21 is to prevent the flow of air, which enters the opening 19 and passes through the nozzle 15 when the suction device is operating, from forming a current flowing back around the turbine 8, inside the top part of the housing 13.

A multiple acoustic damper 25 is also located between the housing 5 of the brush 2 and the housing 13 of the turbine 8. The acoustic damper 25 comprises a chamber 35, associated with the perforated baffle 20, and a chamber 36 associated with the perforated baffle 26. The holes 23 and 27 with which the perforated baffles 20 and 26 are provided connect the chambers 35 and 36 of the damper 25 to the turbine housing 13.

The acoustic damper 25 operates on the principle of a Helmholtz resonator. Therefore the volume of its chambers 35 and 36 and the dimensions of holes 23 and 27 are chosen so as to dampen the acoustic frequencies which are considered to be the most troublesome and which are detected from time to time in the particular turbo-brush, in accordance with criteria which are well-known to the person skilled in the art.

The volume of the acoustic damper 25 ranges from about 1% to about 20% of the overall volume of the turbine rotor and, particularly, is about 7% of the abovementioned overall volume. The volume of the damper 25 is equal to about 6 $cm^3$. The holes 23 and 27 have a diameter which ranges from about 0.5 mm to about 5 mm and which, particularly, is about 2.5 mm, and a length which ranges from about 0.5 mm to about 4 mm and which, particularly, is about 1.5 mm. The length of the holes 23 is equal to the thickness of the baffle 20, while that of the holes 27 is equal to the thickness of baffle 26. The number of holes 23 and 27 ranges from 1 to 100 and, particularly, they are 35 in number. The porosity of the baffles 20 and 26, understood as being the ratio of voids to solid areas, ranges from about 1% to about 50% and preferably ranges from about 5% to about 20%.

The damper 25 has a height, measured with respect to the line of intersection between the baffles 20 and 26 and a plane of longitudinal cross section, which assumes values inversely proportional to the frequencies to be dampened. Therefore, the volume of the damper has a height which is smaller in the zones assigned for damping higher frequencies. The damper has a height which ranges from about 1 to about 30 mm and preferably ranges from about 6 to about 12 mm. For example, the chamber 36 is assigned for damping the high frequencies and the chamber 35 for damping the lower frequencies. However, the acoustic damper 25 may be formed by a single chamber.

The nozzle 15 has an elongation ratio b/h, namely a ratio between width b and height h, which ranges from about 3 to about 7. These dimensions of the nozzle 15 help reduce the noise produced by the turbine without causing losses in power.

When the suction device is in operation, an air flow passes through the opening 19, the nozzle 15 and the suction pipe 14 and removes the dust and rubbish raised by the action of the bristles 3 of the rotating brush 2 passing over a moquette or a carpet. The air flow discharged from the nozzle 15 strikes the vanes 11 of the turbine 8, causing the latter to rotate. The turbine 8, in turn, causes rotation of the brush 2 via the belt 9 with a predefined reduction ratio of the speed of rotation.

The turbo-brush 1 offers the dual advantage of extracting in an efficient manner the energy of the air flow which strikes the turbine and reducing significantly the noise due to the intermittent interaction between air flow and turbine vanes.

With the turbo-brush according to the invention it has been possible to achieve a reduction in the noise level of up to 3 dB and an increase in power and, therefore, in number of revolutions of the turbine of up to 50% with respect to a configuration without a lip.

Figure 4:
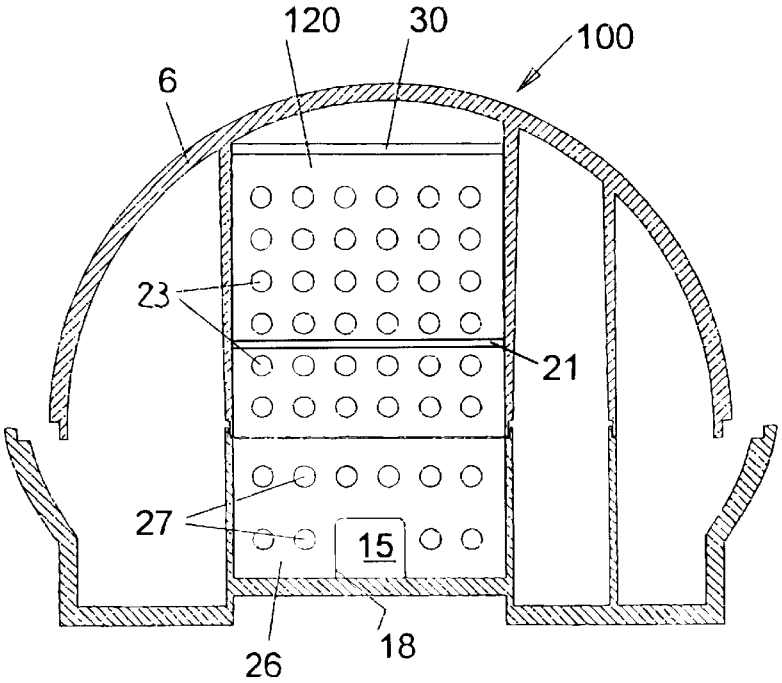
FIG. 4 is a cross-sectional view along the plane indicated by IV—IV in FIG. 3.
Figure 3:
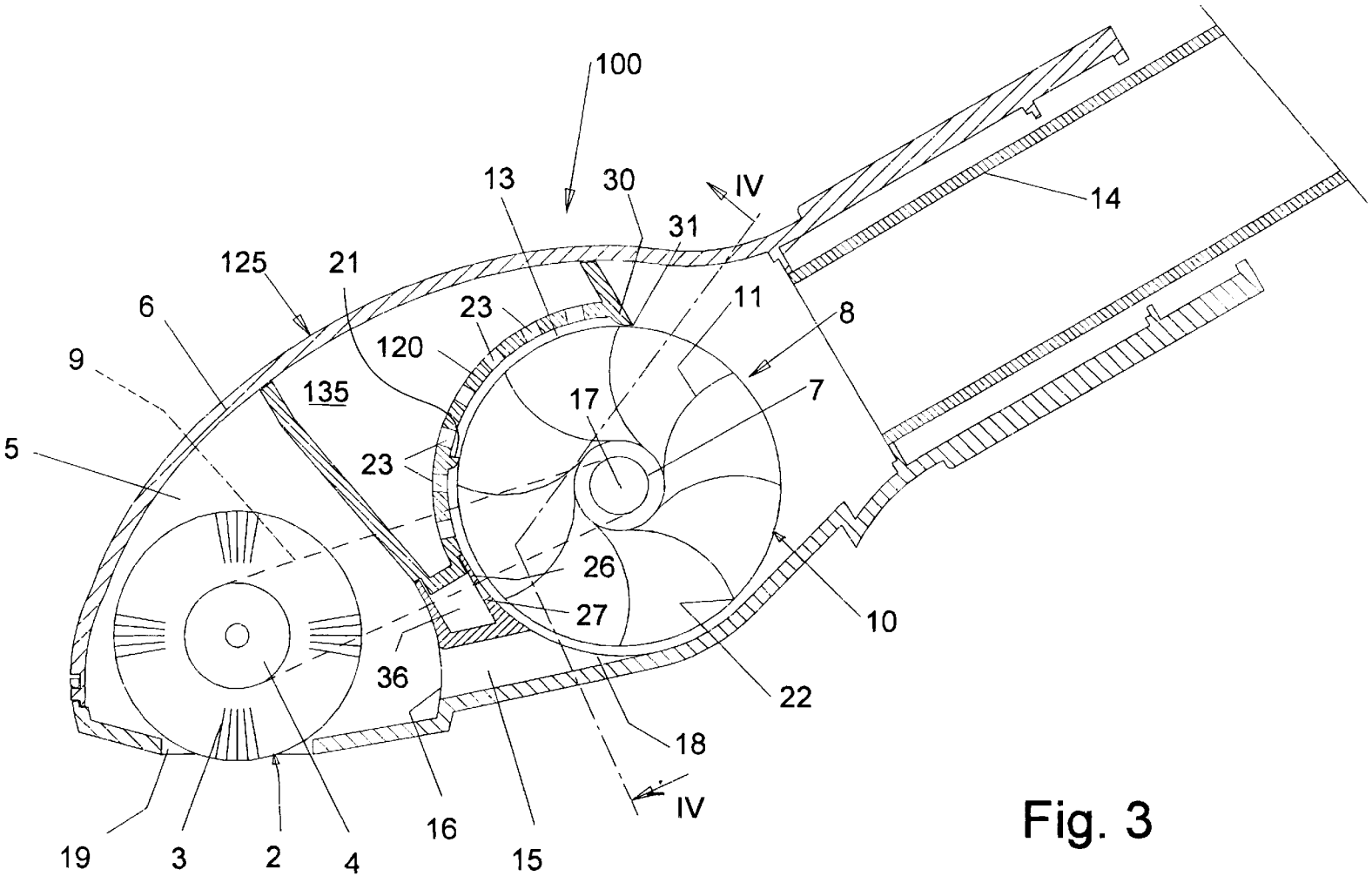
FIG. 3 is a longitudinally sectioned partial view of a variant of the turbo-brush according to FIG. 1.

FIGS. 3 and 4 show a turbo-brush 100 which is a variation of the turbo-brush 1 according to FIG. 1 and in which identical parts are indicated by the same numbers.

The turbo-brush 100 has a perforated baffle 120 provided with holes 23 and a perforated baffle 26 provided with holes 27, which baffles surround the turbine 8 over an angle of about 180°. A lip 30, similar to the lip 21 of the turbo-brush 1, is integral with the perforated baffle 120. The tip 31 of the lip 30 is located at a distance from the outer end 22 of the vanes 11 which ranges from about 0.001% to about 0.1% of the diameter of the rotor 10 of the turbine 8 and, in particular, is about 0.002%. For example, the distance ranges from about 0.05 mm to about 55 mm and, particularly, is about 0.1 mm, while the diameter of the turbine 10 is about 55 mm. The lip 30 is positioned at an angle of about 120° with respect to the axis parallel to the surface to be cleaned, having its origin on the axis 17 of the rotational shaft 7 of the turbine 8 and directed towards the brush 2, the angles measured in the opposite direction with respect to the direction of rotation of the said turbine being positive. The lip 30, like the lip 21, prevents the formation of an air current flowing back around the turbine 8, in the top part of the compartment 13.

According to a variation, in the turbo-brush 100, in addition to the lip 30, a second lip similar to the lip 21 of the turbo-brush 1 may be applied to the perforated baffle 120. In this case, the lips 21 and 30 are located at respective angles which range from about −60° to about 180°, in particular from about −40° to about 130°, with respect to the axis parallel to the surface to be cleaned. For example, the lip 30 is located at angle of about 45° and the lip 21 is located at an angle of about −20° with respect to the axis parallel to the surface to be cleaned. The lip 21 co-operates with the lip 30 so as to prevent the air flow from flowing back towards to the top part of the compartment 13, around the turbine 8.

The turbo-brush 100 has a multiple acoustic damper 125 comprising a chamber 135 associated with the perforated baffle 120 and a chamber 36 associated with the perforated baffle 26. The acoustic damper 125 has dimensions and operates in a similar manner to the acoustic damper 25 of the turbo-brush 1. The acoustic damper 125 may also be formed as a single chamber.

The turbo-brush 100 functions in a manner similar to the turbo-brush 1 and has the same advantages.

We claim:

1. A turbo-brush for cleaning a surface, comprising a casing provided with a suction opening, a rotating brush provided with bristles, a turbine which has a rotor provided with vanes and is operationally connected to said brush, a suction nozzle and a suction pipe connected to a suction device, said casing having a housing inside which said turbine is rotatably supported for rotating about an axis of rotation, said suction nozzle being located between said brush and said turbine for sucking a flow of air from said suction opening, direct it onto said brush and then towards said turbine, wherein said housing of said turbine has a first lip projecting to a distance from a distal end of the vanes of said turbine which ranges from about 0.001% to about 0.1% of the diameter of said rotor of said turbine.

2. The turbo-brush according to claim 1, wherein said distance ranges from about 0.002% to about 0.02% of the diameter of said rotor.

3. The turbo-brush according to claim 1, wherein said distance is about 0.002% of the diameter of said rotor.

4. The turbo-brush according to claim 1, wherein said first lip is located at an angle which ranges from about −60° to about 180° with respect to an axis parallel to a surface to be cleaned, having its origin on the axis of rotation of said turbine and directed towards said brush, the angles measured in the opposite direction with respect to the direction of rotation of said turbine being positive.

5. The turbo-brush according to claim 4, wherein said angle ranges from about −40° to about 130°.

6. The turbo-brush according to claim 5, wherein said angle is about 1°.

7. The turbo-brush according to claim 5, wherein said angle is about 120°.

8. The turbo-brush according to claim 1, wherein said housing of said turbine has a second lip projecting to the distance from the distal end of the vanes of said turbine which ranges from about 0.001% to about 0.1% of the diameter of said rotor of said turbine, the first and second lips being located at respective angles which range from about −60° to about 180° with respect to an axis parallel to a surface to be cleaned, having its origin on the axis of rotation of said turbine and directed towards said brush, the angles measured in the opposite direction with respect to the direction of rotation of said turbine being positive.

9. The turbo-brush according to claim 8, wherein the first and second lips are located at respective angles which range from about −40° to about 130° with respect to said axis parallel to the surface to be cleaned.

10. The turbo-brush according to claim 9, wherein the first and second lips are located, one at an angle of about −20° and the other at an angle of about 45° with respect to said axis parallel to the surface to be cleaned.

11. The turbo-brush according to claim 1, further comprising an acoustic damper coupled to said housing of said turbine, said acoustic damper having a predefined volume and being connected to said housing of said turbine by means of a baffle provided with a predefined number of holes having predefined dimensions, said volumes, said number of holes and their dimensions having values such as to dampen at least one predefined acoustic frequency.

12. The turbo-brush according to claim 11, wherein the volume of said acoustic damper ranges from about 1% to about 20% of the overall volume of said turbine, and said holes have a diameter which ranges from about 0.5 mm to about 5 mm and a length which ranges from about 0.5 mm to about 4 mm and consist of a number which ranges from 1 to 100.

13. The turbo-brush according to claim 12, wherein the volume of said acoustic damper is about 7% of the overall volume of said turbine, and said holes have a diameter of about 2.5 mm and a length of about 1.5 mm and consist of a number equal to 35.

14. The turbo-brush according to claim 11, wherein said baffle has a porosity which ranges from about 1% to about 50%.

15. The turbo-brush according to claim 14, wherein said porosity ranges from about 5% to about 20%.

16. The turbo-brush according to claim 11, wherein said damper has a height, measured with respect to the line of intersection between said baffle and a plane of longitudinal cross section, which assumes values inversely proportional to the frequencies to be dampened.

17. The turbo-brush according to claim 16, wherein said damper has a height which ranges from about 1 to about 30 mm.

18. The turbo-brush according to claim 17, wherein said height ranges from about 6 to about 12 mm.

19. The turbo-brush according to claim 1, wherein said suction nozzle has an elongation ratio b/h, between width b and height h, which ranges from about 3 to about 7.

* * * * *